US008939138B2

(12) United States Patent
Arajakis

(10) Patent No.: US 8,939,138 B2
(45) Date of Patent: Jan. 27, 2015

(54) SIGHT COVER

(71) Applicant: GamePlan Gear LLC, Dubuque, IA (US)

(72) Inventor: Michael M. Arajakis, Boardman, OH (US)

(73) Assignee: GamePlan Gear LLC, Dubuque, IA (US)

( * ) Notice: Subject to any disclaimer, the term of this patent is extended or adjusted under 35 U.S.C. 154(b) by 79 days.

(21) Appl. No.: 13/733,881

(22) Filed: Jan. 3, 2013

(65) Prior Publication Data

US 2013/0174819 A1 Jul. 11, 2013

Related U.S. Application Data

(60) Provisional application No. 61/583,182, filed on Jan. 5, 2012.

(51) Int. Cl.

| | |
|---|---|
| ***F41G 1/467*** | (2006.01) |
| ***F41C 23/02*** | (2006.01) |
| ***F41B 5/14*** | (2006.01) |
| ***F41G 11/00*** | (2006.01) |

(52) U.S. Cl.

CPC ..... *F41C 23/02* (2013.01); *F41B 5/1457* (2013.01); *F41G 11/00* (2013.01); *F41G 1/467* (2013.01)

USPC ..... 124/87; 150/154

(58) Field of Classification Search

USPC ..... 33/465, 265; 124/86, 87; 150/154, 155, 150/156, 157, 158, 159, 160, 161, 162, 163, 150/164, 165

See application file for complete search history.

(56) References Cited

U.S. PATENT DOCUMENTS

| | | | | |
|---|---|---|---|---|
| 3,861,434 | A * | 1/1975 | Harding | 150/160 |
| 4,660,610 | A * | 4/1987 | McIntire, III | 206/349 |
| 4,858,361 | A * | 8/1989 | White | 42/96 |
| 6,716,111 | B2 * | 4/2004 | Liberatore | 473/256 |
| 6,772,881 | B2 * | 8/2004 | Le et al. | 206/305 |
| 6,793,072 | B2 * | 9/2004 | Maeng | 206/315.2 |
| 7,549,451 | B2 * | 6/2009 | Sanchelli | 150/161 |
| 7,559,168 | B2 * | 7/2009 | Wisecup et al. | 42/96 |
| 7,699,083 | B1 * | 4/2010 | Kim | 150/160 |
| 2005/0284459 | A1 * | 12/2005 | Anderson | 124/90 |

* cited by examiner

*Primary Examiner* — John Ricci
(74) *Attorney, Agent, or Firm* — Rathe Lindenbaum LLP

(57) ABSTRACT

A hunting equipment sight cover comprises a pouch shaped to receive a sight; first and second flaps extending from the pouch to wrap about a frame of the sight or a portion of an equipment from which the sight extends; and connectors for connecting distal portions of the first and second flaps to the pouch.

19 Claims, 2 Drawing Sheets

SIGHT COVER

CROSS-REFERENCE TO RELATED PATENT APPLICATIONS

The present application is a continuation application claiming priority under 35 USC Section 120 from co-pending U.S. Provisional Application Ser. No. 61/583,182 filed on Jan. 5, 2012 by Michael M. Arajakis and entitled BOOT SLING SYSTEM AND SIGHT COVER, full disclosure of which is hereby incorporated by reference.

BACKGROUND

Hunting equipment, such as archery bows and firearms, sometimes include optical sights or sight assemblies to facilitate more accurate aiming of the hunting equipment at a target. During transport of the hunting equipment across uneven terrain in the outdoors, such sight assemblies are susceptible to damage.

DETAILED DESCRIPTION OF THE EXAMPLE EMBODIMENTS

Figure 1:
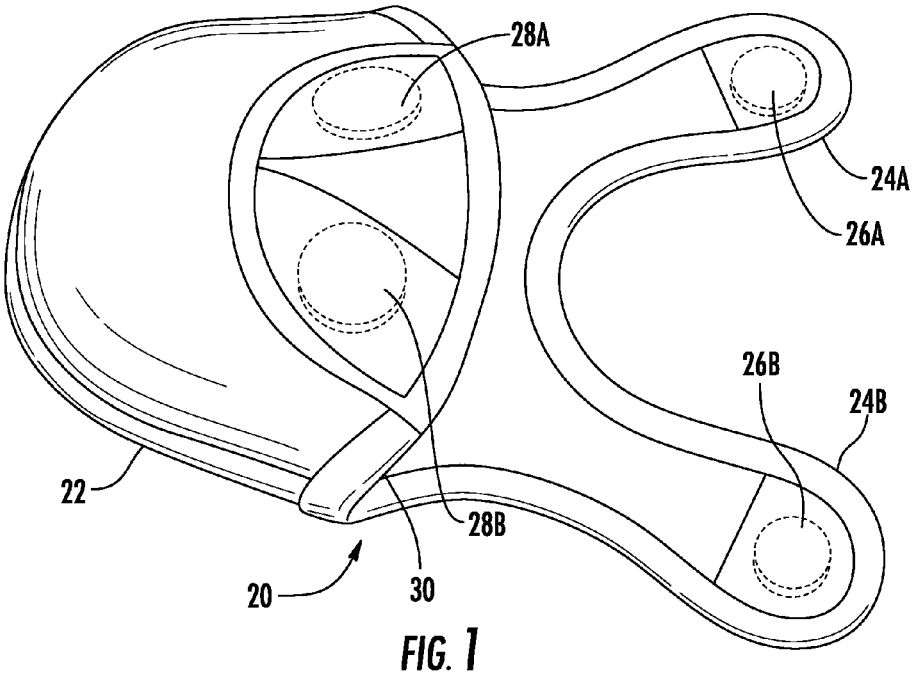
FIG. 1 is a front perspective view of an example hunting equipment sight cover in an open, flap extended state.

FIG. 1 illustrates an example hunting equipment sight (site) cover 20. Hunting equipment sight cover 20 covers and protects an optical sight on hunting equipment, such as archery bows. As will be described hereafter, hunting equipment sight cover 20 is adaptable to different sights having different sizes and configurations while being easily and reliably closed about the optical sight.

Hunting equipment sight cover 20 comprises pouch 22, flaps 24A, 24B (collectively referred to as flaps 24) and connectors 26A, 26B collectively referred to as connectors 26) and connectors 28A, 28B (collectively referred to as connectors 28). Pouch 22 comprises a bag, cap or other enclosure form from one or more layers of material that are sewn, welded, adhered, fastened or otherwise joined to form the an interior 30 sized to receive an optical sight of a hunting equipment. In the example illustrated, pouch 22 comprises a rounded interior, lacking sharp interior corners where a received optical sight may catch during insertion or removal of the optical sight from the interior 30 of pouch 22. In other implementations, pouch 22 may have other shapes.

In the example illustrated, pouch 22 is formed from a resiliently stretchable elastomeric material, allowing pouch 22 to stretch to fit different sizes and styles of archery sights. In the example illustrated, pouch 22 is also formed from a resiliently compressible material, similar to a foam material. As a result, the walls of pouch 22 themselves resiliently compressed to better accommodate the received hunting equipment sight. For example illustrate, the walls of pouch 22 are formed from neoprene. In other implementations, pouch 22 may be formed from other materials.

Flaps 24 comprise legs, bands, fingers or other extensions extending or projecting from pouch 22 and configured to wrap about a frame of the hunting equipment sight or portion of the hunting equipment from which the sight extends so as to retain pouch 22 on and about the hunting equipment sight. In the example illustrated, flaps 24 divergently extend away from one another as they extend away from pouch 22. As a result, flaps 24 may be wrapped about structures at a spacing wider than the spacing of the mouth of pouch 22, further enhancing the ability of sight cover 20 to accommodate different hunting equipment sights.

In the example illustrated, flaps 24 are each formed from a resiliently stretchable and flexible material, allowing flaps 24 to accommodate different styles, shapes and sizes of hunting equipment sights. In the example illustrated, flaps 24 are specifically formed from neoprene. In the example illustrated, flaps 24 are at least partially integrally formed as part of a single unitary and homogenous body with pouch 22. In the example illustrated, a single homogenous layer of material is cut or otherwise formed to form at least both the back panel of pouch 22 and each of flaps 24. As a result, sight cover 20 is more durable, being more resistant to separation her tears along any junction between flaps 24 and pouch 22. In other implementations, flaps 24 may be formed from other materials and may comprise separate structures sewn, adhered, welded or otherwise bonded or joined to pouch 22.

Connectors 26 and 28 comprise mechanisms that cooperate with one another to connect distal portions of flaps 24 to pouch 22 to secure flaps 24 about the archery equipment and to retain the optical sight within pouch 22. Connectors 26 are secured to flaps 24 proximate to distal end portions of flaps 24 while connectors 28 are secured to pouch 22. In one configuration, connector 26A cooperates with connector 28A while connector 26B cooperates with connector 28B for wrap securement. In another configuration, flaps 24 may crisscross one another, wherein connector 26A cooperates with connector 28B and wherein connector 26B cooperates with connector 28A to provide a more constricted smaller wrap about a smaller structure adjacent to the received optical sight.

In the example illustrated, at least one of the cooperating pair of connectors 26, 28 comprises a magnet while the other of the cooperating pair of connectors 26, 28 comprises a material attractable to the magnet (another magnet or a ferromagnetic material). In the example illustrated, each of connectors 26, 28 comprises a rare earth magnet. As a result, connectors 26, 28 provide a reliable connection that may be quickly and easily connected and disconnected. In the example illustrated, each of the magnets forming connectors 26, 28 are captured in sewn between two layers of fabric or material, many accidental separation or dis-lodgment. In one implementation, magnets 26 are sewn between layers forming flaps 24 while magnets 28 are sewn between opposite layers of material along an exterior of pouch 22.

Figure 2:
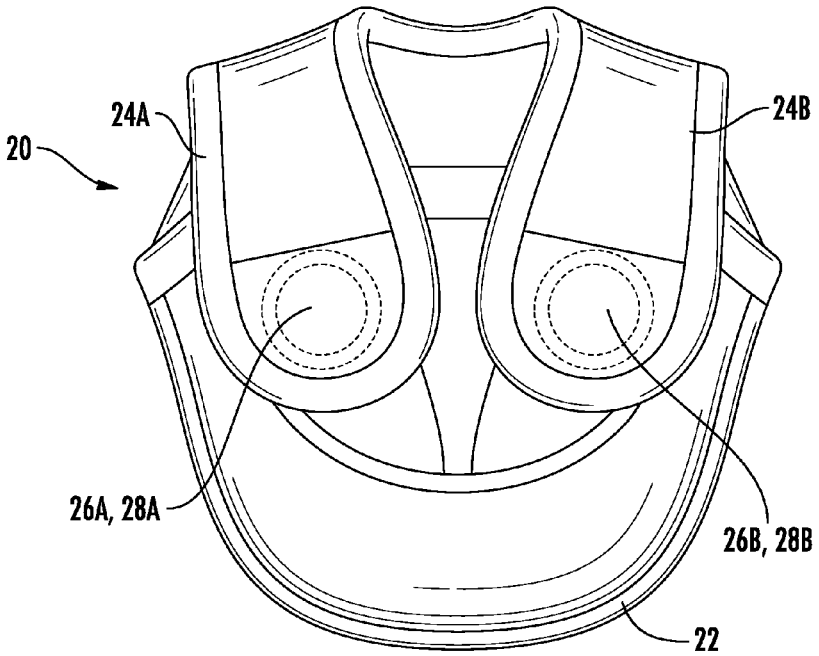
FIG. 2 is a front perspective view of the hunting equipment sight cover of FIG. 1 in a closed, flap wrapped stated.

In the example illustrated, the magnets forming connectors 26 are secured to flaps 24 at a first spacing while the magnets forming connectors 28 are secured to pouch 22 at a second spacing less than the first spacing. In other words, the distance separating the magnet forming connector 26A from the magnet forming connector 26B when flaps 24 are extended as shown in FIG. 1 is greater than the distance separating the magnets forming connector 28A from the magnets forming connector 28B. As a result, as shown by FIG. 2 which illustrates flaps 24 folded or bent from the extended, pouch open position stoning FIG. 1 to the folded, pouch closing position shown in FIG. 2, flaps 24 are retained in place while flaps 24 converge towards one another to better wrap about a frame of the optical sight or a portion of the hunting equipment from which the optical sight extends. In other words, flaps 24 are better able to converge about and grip the structure adjacent to the optical sight to more securely retain pouch 22 about the optical sight and to more completely close the opening her mouth of pouch 22 about the received optical sight. In other implementations, connectors 26 and 28 may have other relative positions. In other implementations, connectors 26, 28 may comprise other connection or releasable fastening mechanisms such as snaps, clips, hooks, buttons, hook and loop (VELCRO) fasteners, clasps and other types of fasteners.

Figure 3:
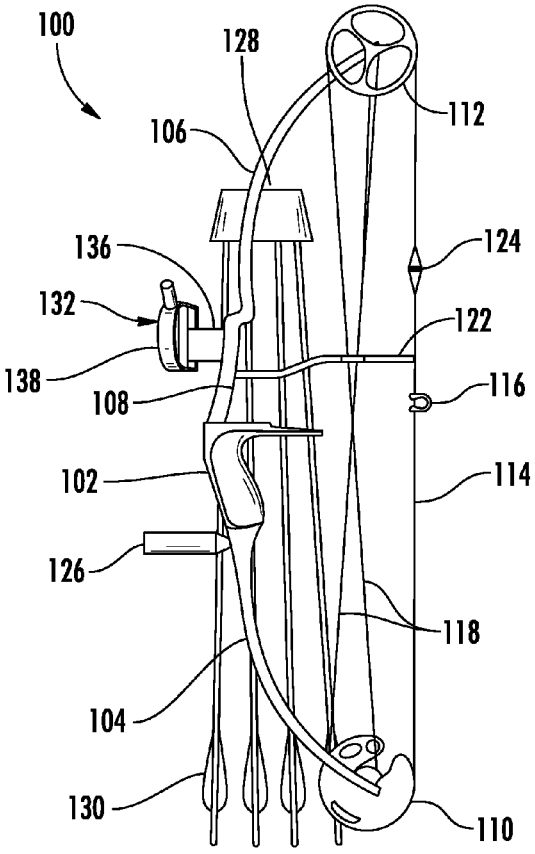
FIG. 3 is a perspective view of an example hunting equipment that a protected by the hunting equipment sight cover of FIG. 1.
Figure 4:
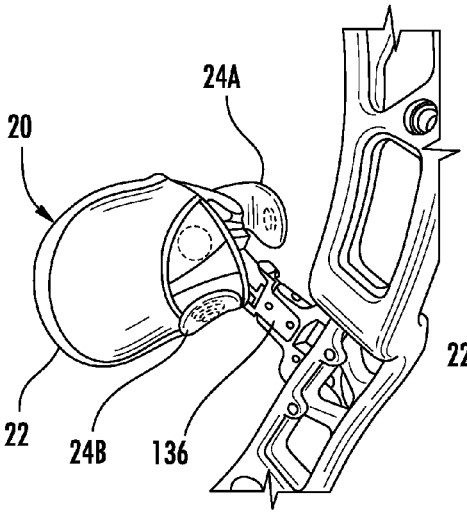
FIGS. 4 and 5 are fragmentary perspective views illustrating positioning of the hunting equipment sight cover of FIG. 1 with respect to the example hunting equipment of FIG. 3.
Figure 5:
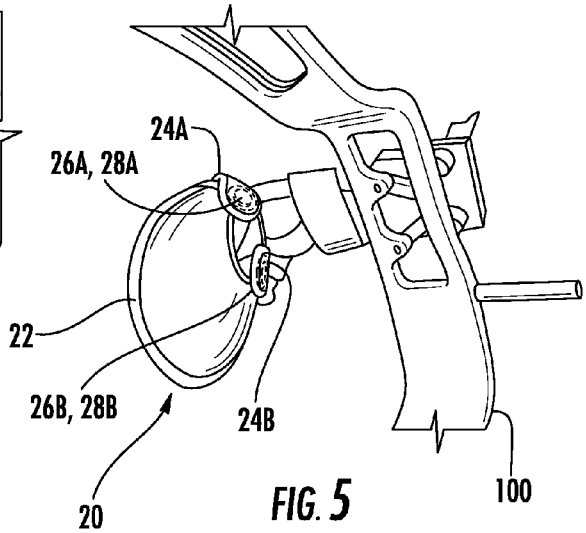

FIGS. 3-5 illustrate one example of a piece of hunting equipment for use of cover 22. FIG. 3 illustrates an example piece of hunting equipment 100 for which cover 22 may be utilized. Hunting equipment 100 comprises a compound archery bow comprising grip 102, lower limb 104, upper limb 106, arrow rest 108, cam 110, idler cam 112, bow string 114, nocking loop 116, cables 118, cable guard 120, peep sight 124, stabilizer 126, bow mounted quiver 128 with received arrows 130 and bow sight. In other implementations, cover 22 may be utilized in various other forms of compound bows or various other forms of bows. In other implementations, cover 22 may be used with other forms of hunting equipment.

As shown by FIG. 4, optical sight 132 (which generally extends in a plane perpendicular to the plane containing grip 102 and limbs 104, 106) is inserted into the interior of pouch 22. In the example illustrated, pouch 22 deforms in shape to accommodate irregular shape of optical sight 132. In the example illustrated, pouch 22 resiliently stretches to further accommodate the shape and size of optical sight 132. Because pouch 22 resiliently stretches, the exterior or outside of pouch 22 closely conforms to the outer profile of the optical sight 132, reducing the likelihood of pouch 22 accidentally catching up on exterior objects. At the same time, the interior of pouch 22 also grips optical sight 132 to better retain pouch 22 on optical sight 132.

As shown by FIGS. 4 and 5, flaps 24 are wrapped about opposite side of the main post 136 supporting the viewing portion 138 of optical sight 132. The magnet of connector 26A magnetically adheres to the magnet of connector 28A. The magnet of connector 26B magnetically adheres to the magnetic connector 28B.

Because connectors 26 and 28 utilize magnets, connectors 26 and 28 are secured to one another by simply bring the faces of such magnets into sufficiently close proximity for magnetic attraction. As a result, connectors 26 and 28 may be easily brought into appropriate alignment and connection with one another. This feature is particularly beneficial with respect hunting equipment optical sights which may have extremely different and extremely complicated shapes and configurations while being very compact and closely spaced. In contrast to snaps, buttons, clasps and many other fasteners which may require precise alignment and precise movement of cooperating connector portions along precise predefined axes to facilitate connection, the magnets of connectors 26, 28 simply need to be brought into general proximity to one another (from virtually any direction) to facilitate connection. As a result, flaps 24 may be easily moved to a pouch closing position and a easily wrapped in a reliable tight wrap about the optical sight supporting structure, despite variations in the configuration of different optical sights and despite the relatively small gaps and spaces in which flaps 24 must extend and be folded. The example implementation of sight cover 20 and its use of magnets for connectors 26, 28 may be extremely beneficial for those persons having relatively large hands or for those persons wearing gloves, such as in cold hunting environments. The use of magnets for connectors 26, 28 may allow a person to connect or disconnect connectors 26, 28 and to secure or remove sight cover 20 all while the person continues to wear his or her gloves in cold environments.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A hunting equipment sight cover comprising:

a pouch shaped to receive a sight;

first and second flaps extending from the pouch to wrap about a frame of the sight or a portion of an equipment from which the sight extends; and connectors for connecting distal portions of the first and second flaps to the pouch, wherein the connectors comprise magnets.

2. The sight cover of claim 1, wherein the magnets comprise first magnets received within the first and second flaps.

3. The sight cover of claim 2, wherein the first magnets are sewn between two layers of fabric forming the first and second flaps.

4. The sight cover of claim 3, wherein the magnets further comprise second magnets coupled to the pouch.

5. The sight cover of claim 4, wherein the first magnets and the second magnets comprise rare earth magnets.

6. The sight cover of claim 4, wherein the first magnets have a first spacing and wherein the second magnets have a second spacing less than the first spacing.

7. The sight cover of claim 1, wherein the straps are resiliently stretchable.

8. The sight cover of claim 1, wherein the pouch and the first and second straps are integrally formed as a single unitary homogenous body of a resiliently stretchable material.

9. The sight cover of claim 8, wherein the resiliently stretchable material comprises neoprene.

10. The sight cover of claim 1, wherein the magnets comprise rare earth magnets secured to the pouch.

11. A hunting equipment sight cover comprising:

a pouch shaped to receive a sight;

first and second resiliently stretchable flaps extending from the pouch to wrap about a frame of the sight or a portion of an equipment from which the sight extends; and first rare earth magnets received within each of the first and second flaps for connecting distal portions of the first and second flaps to the pouch; and second rare earth magnets secured to the pouch.

12. The sight cover of claim 11, wherein the pouch and the first and second straps are integrally formed as a single unitary homogenous body of a resiliently stretchable material.

13. The sight cover of claim 12, wherein the resiliently stretchable material comprises neoprene.

14. The sight cover of claim 11, wherein the first rare earth magnets have a first spacing and wherein the second rare earth magnets have a second spacing less than the first spacing.

15. An apparatus comprising:

an archery bow having an optical sight;

a pouch receiving the sight;

first and second resiliently stretchable flaps extending from the pouch to wrap about the sight; and connectors for connecting distal portions of the first and second flaps to the pouch.

16. The apparatus of claim 15, wherein the connectors comprise magnets.

17. The apparatus of claim 16, wherein the magnets are sewn between two layers of fabric forming the first and second flaps.

18. The apparatus of claim 15, wherein the connectors comprise:

first magnets secured to each of the first and second flaps at a first spacing; and second magnets secured to the pouch at a second spacing less than the first spacing.

19. The apparatus of claim 18, wherein the pouch and the first and second straps are integrally formed as a single unitary homogenous body of a resiliently stretchable material.

* * * * *